169-47 SR
12/13/77 OR 4,062,407

United States Patent [19]
Bentrup

[11] 4,062,407
[45] Dec. 13, 1977

[54] FIRE EXTINGUISHER SYSTEM USING LIQUID-BALLAST TIRES

[75] Inventor: Otto Theodore Bentrup, Terre Haute, Ind.

[73] Assignee: J. I. Case Company, Racine, Wis.

[21] Appl. No.: 708,314

[22] Filed: July 26, 1976

[51] Int. Cl.² ..... A62C 1/06; A62C 13/46; A62C 27/30

[52] U.S. Cl. ..... 169/47; 152/DIG. 5; 169/9; 239/147; 280/5 B

[58] Field of Search ..... 169/43, 46, 47, 24, 169/54, 62, 9; 239/147, 289, 373; 152/DIG. 5; 280/1, 5 B

[56] References Cited

U.S. PATENT DOCUMENTS

| | | | |
|---|---|---|---|
| 2,767,796 | 10/1956 | Roberts | 169/9 X |
| 2,847,049 | 8/1958 | Blomquist | 152/DIG. 5 X |
| 3,169,581 | 2/1965 | Cummins | 280/5 B X |
| 3,191,974 | 6/1965 | Mann et al. | 280/5 B X |

*Primary Examiner*—John J. Love
*Assistant Examiner*—Andres Kashnikow
*Attorney, Agent, or Firm*—Arthur J. Hansmann

[57] ABSTRACT

A fire extinguisher system using liquid-ballast tires of a vehicle, such as a tractor or log skidder. The tire has a fire retardant liquid, and it may be water, and it has several valves spaced therearound. A gas supply can be attached to one of the valves to force the liquid from the tire, and a hose can be attached to another one of the valves for directing the evacuating liquid from the tire and toward the fire.

5 Claims, 1 Drawing Figure

FIRE EXTINGUISHER SYSTEM USING LIQUID-BALLAST TIRES

This invention relates to a fire extinguisher system using liquid-ballast tires, and, more particularly, it relates to method and apparatus for combating a fire and utilizing the liquid-ballast tire of a log skidder or the like.

BACKGROUND OF THE INVENTION

This invention is particularly applicable to tractors or log skidders since fires frequently occur on log skidders or in connection with the use of log skidders, and the fire extinguishing apparatus commonly available is usually not adequate for extinguishing these fires. However, log skidders are commonly equipped with tires having liquid ballast therein, and these tires therefore have increased traction effectiveness. These tires can actually contain from 100 to 200 gallons of liquid, depending upon the tire size, and this liquid can be water or other fire retardant liquid. Of course it is also understood that the log skidder is commonly used in the woods or forest, and it is important to have adequate fire fighting equipment available for extinguishing a fire on the skidder itself or in the immediate surroundings of the skidder or like tractor equipment.

The present invention provides a system for combining low cost and commercially available equipment for fighting fires of the nature mentioned above, and it of course provides a method for utilizing apparatus and for directing the fire retardant liquid from a liquid-ballast tire and onto the fire.

Still further, the present invention provides apparatus and method for quickly and easily obtaining fire fighting means and a method, wherein the fire can be adequately combated even though it occurs in remote locations which do not have water supply or like fire fighting equipment. In accomplishing these objectives, the method and apparatus of this invention are of a simplified but yet effective and available type of equipment which can be readily and easily transported and which can be readily and easily placed into the operative positions for obtaining the fire retardant liquid and applying it to the fire.

Still further, the present invention provides a method and apparatus which utilizes the liquid ballast type of tire and which renders each of the vehicles several tires readily and easily available for exhausting the liquid from the tire in the combating of the fire. That is, the apparatus of this invention can be applied to one of the vehicle tires to exhaust the water or other liquid therefrom, and it can be readily and easily disconnected and rapidly connected to another tire for obtaining the fire fighting liquid from that and the other tires of the vehicle, as needed. In accomplishing these objectives, the method and apparatus of this invention provides for the quick connect and quick disconnect of the apparatus relative to each of the tires of the vehicle.

Other objects and advantages will become apparent upon reading the following description in light of the accompanying drawings.

DETAILED DESCRIPTION OF THE PREFERRED EMBODIMENT

Figure 1:
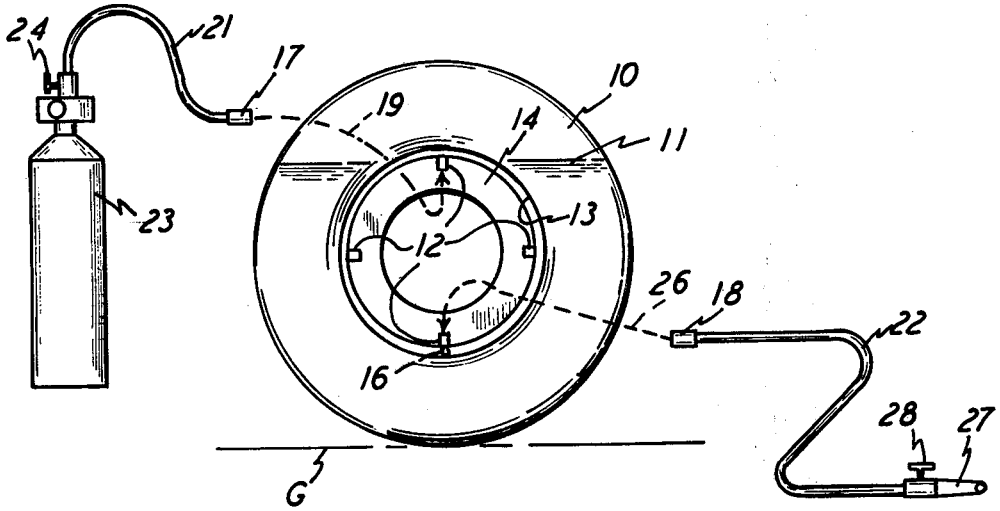
FIG. 1 is a side elevational view of a vehicle liquid-ballast tire with the apparatus of this invention related thereto.

The drawing shows the apparatus of this invention, and the following description, in connection with the appended claims, will fully describe the apparatus and the method will also be apparent therefrom. A vehicle tire 10 is indicated to have a liquid ballast therein and extending to the level or line designated 11 which indicates the upper level of the liquid in the tire 10. The tire 10 may of course be the usual tire on a log skidder or tractor or the like, and the tires are commonly filled with a liquid ballast, such as water, to increase the tractive power of the tire, and the tire can contain hundreds of gallons of liquid, depending upon its size. Of course the tire would be mounted on the vehicle and would be supporting the vehicle on the ground and used for mobilizing the vehicle, all in the usual manner of arranging and using a vehicle tire, and the ground line is indicated at G.

The tire 10 has four valves 12 shown equally spaced around the interior circumference 13 of the tire 10, and the tire rim 14 is also shown. The valves 12 are arranged with a valve check member therein, such as the members designated at 16 in the lower one of the valves 12, and that is the valve 12 closest to the ground line G, though all of the valves have a check member therein to preclude the inadvertent escape of the liquid from the tire 10. Also, the valves 12 are arranged with the usual and well-known type of connect and disconnect connectors, such that a connector, such as the shown connectors 17 and 18, can be readily applied to the valves 12, as shown by the dotted lines 19, and thus the fluid can flow either to or from the tire 10 and to or from the respective connectors 17 and 18, as mentioned hereinafter. Thus, the valves 12 are of the two-way-flow type. Therefore, the valves 12 are shown spaced around the tire 10 and have check members therein to preclude the escape of the liquid from the interior of the tire 10, and the valves 12 are also arranged with the quick connect and disconnect standard type of connectors, such as the snap-on or press-on type which are commonly available commercially and are well known by anyone skilled in the art of fluid valves and conduits.

The connectors 17 and 18 have respective conduits or hoses 21 and 22 fluid-flow connected therewith, and the hose 21 is shown connected with a gas supply tank 23 having a valve 24 interposed between the tank 23 and the hose 21 for the control of the gas from the tank 23 and through the hose 21 and into the tire 10. That is, upon connecting the connector 17 with the upper one of the valves 12, and that is the one to which the dotted line 19 is extending, and of course the tire is motionless or standing still at that time, then the supply of pressurized gas from the tank 23 can be introduced into the tire 10 when the valve 24 is opened and the connector 17 is connected with that upper valve 12, as described and as will be apparent to one skilled in the art. With that connected arrangement described, the pressurized gas from the tank 23 will enter the tire 10 and will force the liquid from the tire when one of the lower valves 12 has its check member 16 in the open position, and that would be when the connector 18 is connected with the lower valve 12, as indicated by the dotted line 26. The liquid in the tire 10 will then be forced through the lower valve 12 and into the conduit 22 and to a nozzle 27 which is fluid-flow connected with the conduit 22 and is shown to have a valve 28 thereon. Therefore, the liquid from the tire 10 will forced from the tire and into the conduit 22 and the liquid can then be directed at the fire.

Accordingly, the valves 12 and the connectors 17 and 18 are arranged to mate together and are of the quick disconnect type which is commonly known and understood by anyone skilled in the art.

With the four valves 12 spaced around the tire, such as in the arrangement shown, then one of the valves will always be near the top of the tire or the upper position for that valve, as defined herein, and also another one of the valves will always be near the bottom of the tire, or in a lower position, as defined herein. As such, the pressurized gas will go to the top of the tire, and the liquid which is in the bottom of the tire will be forced from the tire and through the conduit 22, as desired. The liquid can be any fire-retarding liquid, and water can be used. Also, the pressurized gas in the container 23 is preferably of a non-flammable type, preferably dry air or nitrogen. A cylinder or tank 23 of only a reasonable size and weight would be sufficient to purge or evacuate two to four of the tires 10, depending upon the tire size, and this therefore assures hundreds of gallons of liquid for fighting the fire.

From the aforementioned, the method will also be apparent in that it consists of the steps of placing the liquid into the tire 10 and arranging the tire with the several valves spaced therearound and then connecting the respective connector 17 and 18 with the respective upper and lower valves and thus releasing the pressurized gas to the interior of the tire 10 and receiving the evacuation of the liquid from the tire 10 and in the conduit 22, and directing that liquid onto the fire.

What is claimed is:

1. A method of providing fire-fighting water in a vehicle having inflatable tires, comprising the steps of arranging a fluid-inflatable vehicle tire with several quick-connect connector valves equally spaced around the tire for introducing and removing fluid relative to the tire, inflating the tire with a fire retarding liquid, connecting a first conduit having a quick-connect connector to one of said valves in the lowest position on the tire when the tire is motionless and it is desired to remove the liquid from the tire to fight a fire, connecting a second conduit having a quick-connect connector and a pressurized supply of a fluid to one of said valves in an upper position on the tire and releasing the pressurized fluid to the interior of the tire and thereby force the liquid out of the tire through said lowest one of said valves and said first conduit.

2. The method of providing fire-fighting water in a vehicle having inflatable tires as claimed in claim 1, including the steps of providing the pressurized fluid in the form of a non-flammable gas and the liquid in the form of water, metering said gas to the interior of the tire for controlling the forced evacuation of the water from the tire.

3. A fire extinguisher system using liquid-ballast tires, comprising a vehicle tire having a fire retarding liquid therein, at least several identical two-way-flow and quick-connect valves affixed to said tire at locations equally spaced therearound, and a flexible liquid conduit having a quick-connect valve connector connected with the one of said valves in the lowest position when said tire is motionless, for removing the liquid from said tire, a container of a pressurized supply of a gas and having a conduit with a quick-connect valve connector connected with one of said valves in an upper position relative to said lowest valve and when said tire is motionless, for introducing the gas under pressure and into said tire and forcing the liquid from said tire.

4. The fire extinguisher system as claimed in claim 3, including a nozzle connected with said flexible conduit for the controlled flow of the liquid from said flexible conduit.

5. The fire extinguisher system as claimed in claim 3, wherein said valves are a total of four in number and are respectively located at each one-quarter segment of said tire.

* * * * *